US010947628B2

(12) United States Patent
Shin et al.

(10) Patent No.: US 10,947,628 B2
(45) Date of Patent: Mar. 16, 2021

(54) SYSTEM FOR ELECTROCHEMICAL OF CARBON DIOXIDE

(71) Applicant: SOGANG UNIVERSITY RESEARCH & BUSINESS DEVELOPMENT FOUNDATION, Seoul (KR)

(72) Inventors: Woonsup Shin, Seoul (KR); Soojin Jeong, Seoul (KR); Mi Jung Park, Seoul (KR)

(73) Assignee: Sogang University Research & Business Development Foundation, Seoul (KR)

( * ) Notice: Subject to any disclaimer, the term of this patent is extended or adjusted under 35 U.S.C. 154(b) by 0 days.

(21) Appl. No.: 16/250,569

(22) Filed: Jan. 17, 2019

(65) Prior Publication Data

US 2019/0153606 A1 May 23, 2019

Related U.S. Application Data

(63) Continuation of application No. PCT/KR2017/007711, filed on Jul. 18, 2017.

(30) Foreign Application Priority Data

Jul. 20, 2016 (KR) ..... 10-2016-0091896

(51) Int. Cl.

| | |
|---|---|
| ***C25B 3/04*** | (2006.01) |
| ***C25B 9/00*** | (2021.01) |
| ***C25B 11/18*** | (2006.01) |

(52) U.S. Cl.

CPC ..... *C25B 3/04* (2013.01); *C25B 9/00* (2013.01); *C25B 11/18* (2013.01)

(58) Field of Classification Search

CPC ..... C25B 3/04; C25B 9/00; C25B 11/18

See application file for complete search history.

(56) References Cited

U.S. PATENT DOCUMENTS 3,720,591 A * 3/1973 Skarlos ..... C25B 3/04 562/597

4,673,473 A 6/1987 Ang et al.

FOREIGN PATENT DOCUMENTS

CN 103119204 A 5/2013
CN 103140608 A 6/2013

(Continued)

OTHER PUBLICATIONS

International Search Report of PCT/KR2017/007711 dated Oct. 23, 2017.

(Continued)

*Primary Examiner* — Nicholas A Smith

(74) *Attorney, Agent, or Firm* — Greer, Burns & Crain, Ltd.

(57) ABSTRACT

The present disclosure provides a system for electrochemical conversion of carbon dioxide, including: a reduction electrode unit to which carbon dioxide is supplied and including a metal-containing electrode; an oxidation electrode unit including a sacrificial electrode; and an electrolyte unit including an aprotic polar organic solvent and an auxiliary electrolyte, which is in contact with the reduction electrode unit and the oxidation electrode unit, and the carbon dioxide supplied to the reduction electrode unit is electrochemically reduced so as to produce an oxalate salt.

6 Claims, 15 Drawing Sheets

(56) References Cited

FOREIGN PATENT DOCUMENTS

| | | | |
|---|---|---|---|
| CN | 105765109 | A | 7/2016 |
| KR | 101324742 | B1 | 10/2013 |
| KR | 1020140012017 | A | 1/2014 |
| KR | 101750279 | B1 | 6/2017 |
| WO | 2012120571 | A1 | 9/2012 |
| WO | 2014100828 | A1 | 6/2014 |

OTHER PUBLICATIONS

Giuseppe Silvestri et al., "Use of Sacrificial Anodes in Synthetic Electrochemistry. Processes Involving Carbon Dioxide," Acta Chemica Scandinavica, 1991, vol. 45, pp. 987-992.

* cited by examiner (a) COUNTER ELECTRODE : Pt COIL
(b) WORKING ELECTRODE : DENTAL AMALGAM DISC (0.2 $cm^2$)
(c) REFERENCE ELECTRODE : $Ag/Ag^+$ (1 mM $AgClO_4$ in ELECTROLYTE)
(d) GAS PURGING : Ar AND $CO_2$
(e) ELECTROLYTE

SYSTEM FOR ELECTROCHEMICAL OF CARBON DIOXIDE

CROSS-REFERENCE TO RELATED APPLICATIONS

This application is a continuation of PCT Application No. PCT/KR2017/007711, filed on Jul. 18, 2017, which claims priority to Korean Patent Application Number 10-2016-0091896, filed on Jul. 20, 2016, both of which are hereby incorporated by reference in their entirety.

TECHNICAL FIELD

The present disclosure relates to a system for electrochemical conversion of carbon dioxide in which carbon dioxide is electrochemically reduced so as to produce an oxalate salt.

BACKGROUND

In recent years, abnormal weather phenomena have been worsened by greenhouse effects and have caused heavy damages, and, thus, worldwide efforts and studies are being made to reduce emission of carbon dioxide in the atmosphere. The highest carbon dioxide emission areas in the U.S. from 1990 to 2012 were power plants (32%), transportation (28%), and industry (20%). Accordingly, there have been continuous attempts to capture and reduce carbon dioxide emitted from massive emission sources such as power plants in order to maintain the concentration of carbon dioxide in the atmosphere. Such studies can be roughly classified into two fields: carbon capture and storage (CCS) of carbon dioxide from massive carbon dioxide emission sources and carbon capture and utilization (CCU) of carbon dioxide from massive carbon dioxide emission sources.

The CCS technology is designed to capture carbon dioxide emitted from massive carbon dioxide emission sources and package and bury carbon dioxide in confined spaces to isolate carbon dioxide from the atmosphere. Carbon dioxide is stored mainly by carbonation of inorganic catalysts and a container confining carbon dioxide therein is stored in deep sea strata and under the surface of the earth, which may cause damage to ecosystems, and the like. Therefore, it is difficult to commercialize the CCS technology. In contrast, the CCU technology does not require any storage space but produces profits, and, thus, it is advantageous for commercialization in terms of environment and economics. Particularly, an electrochemical method can produce various organic compounds such as formic acid, carbon monoxide, methanol, oxalic acid, etc. selectively depending on the choice of electrode material and can be performed at normal temperature and pressure. Therefore, the system can be configured at low cost and can be easily miniaturized depending on the design of the reactor or easily designed to have large capacity by stacking and thus has received attention due to its applicability to various industries.

A dental amalgam electrode is an alloy material made up of mercury, tin, silver, and copper and an electrode material showing high selectivity and stability in electrochemically converting carbon dioxide. Since the dental amalgam electrode has a high overvoltage for hydrogen reduction reaction in an aqueous solution, it can convert carbon dioxide into formic acid with high efficiency and produce formic acid while maintaining efficiency of 90% or more at a current density of 100 mA/cm$^2$ over a month in certain conditions.

An oxalic acid is prepared mainly by acidifying the bark of trees which contains oxalate salt ($C_2O_4^{2-}$) or oxidizing carbohydrate or glucose in the presence of metal catalyst. The oxalic acid is used mainly as polish, household cleanser, rust inhibitor (varnish), and the like and produced worldwide in the amount of about 12,000 tons per year. Electrochemical conversion of carbon dioxide into $C_2O_4^{2-}$ is a reaction with two electrons such as carbon monoxide, formic acid, or the like and thus requires low cost of electricity as compared with methanol (six electrons), methane (eight electrons), and the like, uses a single cell and thus requires low device configuration cost, and can reuse the electrolyte and thus is environmentally friendly. Although it has a smaller market than other converted products, carbon dioxide is the most abundant carbon resource on the earth if the electrochemical method is used. Therefore, it is considered as an alternative to conventional processes due to little cost of raw materials and low cost of production.

Meanwhile, an earlier study found that reduction of carbon dioxide to $C_2O_4^{2-}$ can occur with lead (Pb) and mercury (Hg) electrodes using dimethyl formamide (DMF), which is an aprotic organic solvent, as an electrolyte [E Lamy, J. Electroanal. Chem. (1977) 78, 403-407]. A method of producing zinc oxalate ($ZnC_2O_4$) using a sacrificial zinc anode as a counter electrode and precipitating $ZnC_2O_4$ was developed based on the above-described study, and since $ZnC_2O_4$ is insoluble in an aprotic organic solvent, $C_2O_4^{2-}$ can be efficiently separated [Weixin Lv, J. Solid State Electrochem. (2013) 17, 2789-2794]. In the carbon dioxide reduction system, a lead (Pb) plate electrode (1 cm$^2$), a sacrificial zinc anode (1 cm$^2$), an Ag rod (Quasi reference electrode), acetonitrile, and tetrabutylammonium perchlorate (TBAP) were used as a working electrode, a counter electrode, a reference electrode, a solvent, and an auxiliary electrolyte, respectively.

A conventionally-known carbon dioxide reduction system can effectively produce $C_2O_4^{2-}$ with high efficiency but has several problems with industrial application. Firstly, acetonitrile which is a solvent is highly volatile, and, thus, a sealed system is needed, which increases the device configuration cost. Further, zinc cyanide which is a by-product may be produced at about −3.0 V, and, thus, it is difficult to produce high-purity $C_2O_4^{2-}$. Furthermore, TBAP which is an auxiliary electrolyte contains perchlorate that is highly explosive, and the system exhibits the highest efficiency at 5° C., and, thus, a temperature controller is needed, and by-products produced in addition to a target product lowers the purity of product. A low-purity $C_2O_4^{2-}$ product needs to be further processed, which increases the cost for commercialization, and, thus, it needs to be improved.

DISCLOSURE OF THE INVENTION

Problems to be Solved by the Invention

The present disclosure provides a system for electrochemical conversion of carbon dioxide, including: a reduction electrode unit to which carbon dioxide is supplied and including a metal-containing electrode; an oxidation electrode unit including a sacrificial electrode; and an electrolyte unit including an aprotic polar organic solvent and an auxiliary electrolyte, which is in contact with the reduction electrode unit and the oxidation electrode unit, and the carbon dioxide supplied to the reduction electrode unit is electrochemically reduced so as to produce an oxalate salt.

Further, the present disclosure provides a system configured to stably and efficiently produce an oxalate salt based on electrochemical reduction of carbon dioxide in aprotic organic solvent conditions.

However, problems to be solved by the present disclosure are not limited to the above-described problems. Although not described herein, other problems to be solved by the present disclosure can be clearly understood by a person with ordinary skill in the art from the following description.

Means for Solving the Problems

An aspect of the present disclosure provides a system for electrochemical conversion of carbon dioxide, including: a reduction electrode unit to which carbon dioxide is supplied and including a metal-containing electrode; an oxidation electrode unit including a sacrificial electrode; and an electrolyte unit including an aprotic polar organic solvent and an auxiliary electrolyte, which is in contact with the reduction electrode unit and the oxidation electrode unit, and the carbon dioxide supplied to the reduction electrode unit is electrochemically reduced so as to produce an oxalate salt.

Effects of the Invention

A system for electrochemical conversion of carbon dioxide according to an embodiment of the present disclosure can electrochemically reduce and convert carbon dioxide into an oxalate salt in an environmentally friendly and efficient manner, and it can be industrially used.

The system for electrochemical conversion of carbon dioxide according to an embodiment of the present disclosure can be used to obtain a high-purity oxalate salt and uses carbon dioxide which is an abundant carbon resource, and, thus, it is possible to provide an oxalate salt at low production cost.

According to an embodiment of the present disclosure, an electrolyte material which has low volatility and is not explosive is used, and, thus, the system can have a simple configuration and the device configuration cost can be reduced. Therefore, it can be industrially used.

BEST MODE FOR CARRYING OUT THE INVENTION

Figure 1A:
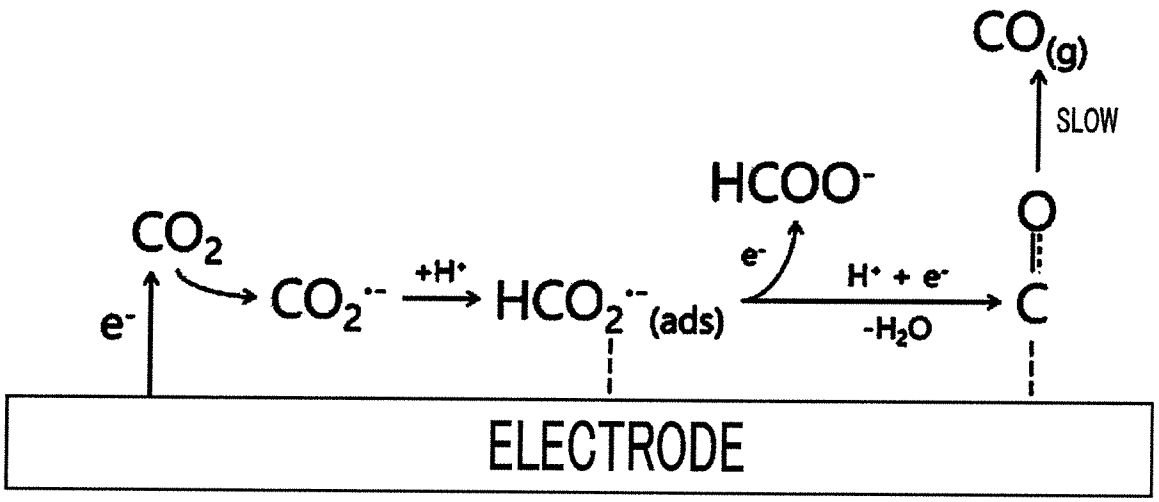
FIG. 1A illustrates a reduction reaction of carbon dioxide in an aqueous solution as an electrochemical reduction mechanism of carbon dioxide according to an embodiment of the present disclosure.

Hereafter, embodiments and examples will be described in detail with reference to the accompanying drawings so that the present disclosure may be readily implemented by those skilled in the art. However, it is to be noted that the present disclosure is not limited to the embodiments and examples but can be embodied in various other ways. In the drawings, parts irrelevant to the description are omitted for the simplicity of explanation, and like reference numerals denote like parts through the whole document.

Throughout this document, the term "connected to" may be used to designate a connection or coupling of one element to another element and includes both an element being "directly connected" another element and an element being "electronically connected" to another element via another element.

Through the whole document, the term "on" that is used to designate a position of one element with respect to another element includes both a case that the one element is adjacent to the other element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Through the whole document, the term "about or approximately" or "substantially" is intended to have meanings close to numerical values or ranges specified with an allowable error and intended to prevent accurate or absolute numerical values disclosed for understanding of the present disclosure from being illegally or unfairly used by any unconscionable third party.

Through the whole document, the term "step of" does not mean "step for".

Through the whole document, the term "combination(s) of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through the whole document, a phrase in the form "A and/or B" means "A or B, or A and B".

Hereinafter, embodiments and examples of the present disclosure will be described in detail with reference to the accompanying drawings. However, the present disclosure may not be limited to the following embodiments, examples, and drawings.

An aspect of the present disclosure provides a system for electrochemical conversion of carbon dioxide, including: a reduction electrode unit to which carbon dioxide is supplied and including a metal-containing electrode; an oxidation electrode unit including a sacrificial electrode; and an electrolyte unit including an aprotic polar organic solvent and an auxiliary electrolyte, which is in contact with the reduction electrode unit and the oxidation electrode unit, and the carbon dioxide supplied to the reduction electrode unit is electrochemically reduced so as to produce an oxalate salt.

In an embodiment of the present disclosure, the metal-containing electrode may include a member selected from the group consisting of Hg, Ag, Sn, Cu, Zn, Sb, alloys thereof, amalgam, and combinations thereof. For example, the metal-containing electrode may contain dental amalgam, and the metal-containing electrode may have a disc shape, a rod shape, or the like, but may not be limited thereto. Dental amalgam is a material regarded as harmless to humans, and if a dental amalgam electrode is used, it is possible to improve environment friendliness and effectively reduce the risk of large-scale electrodes required for industrialization. For example, the amalgam may contain Hg in the amount of from about 35 parts by weight to about 55 parts by weight, Ag in the amount of from about 14 parts by weight to about 34 parts by weight, Sn in the amount of from about 7 parts by weight to about 17 parts by weight, and Cu in the amount of from about 4 parts by weight to about 24 parts by weight, but may not be limited thereto.

In an embodiment of the present disclosure, the sacrificial electrode may be selected from the group consisting of Zn, Mg, Li, Na, Al, and combinations thereof, but may not be limited thereto. Further, the sacrificial electrode may contain a metal having a foil shape, a coil shape, or the like, but may not be limited thereto.

In an embodiment of the present disclosure, the aprotic polar organic solvent may include a member selected from the group consisting of dimethyl sulfoxide, dimethylformamide, and combinations thereof. Most desirably, the system for electrochemical conversion of carbon dioxide according to an embodiment of the present disclosure may use dimethyl sulfoxide as the aprotic polar organic solvent. The aprotic polar organic solvent is rarely evaporated at room temperature and thus can remove the volatility and risk of explosion which is a problem of conventional electrolytes. Therefore, the system can have a simple configuration and the device configuration cost can be reduced.

In an embodiment of the present disclosure, the auxiliary electrolyte may include a member selected from the group consisting of tetrabutylammonium hexafluorophosphate ($TBA.PF_6$), tetrabutylammonium perchlorate (TBAP), tetrabutylammonium tetrafluoroborate ($TBA.BF_4$), and combinations thereof. Most desirably, the system for electrochemical conversion of carbon dioxide according to an embodiment of the present disclosure may use tetrabutylammonium hexafluorophosphate ($TBA.PF_6$) as the auxiliary electrolyte.

The electrochemical reduction according to an embodiment of the present disclosure may be performed by various methods such as applying a constant voltage or changing a potential. For example, if a constant voltage is applied or a potential is changed during the electrochemical reduction, a range of applied voltage value or potential change may be from about −3.2 V to about −1.4 V (reference electrode: $Ag/Ag^+$), but may not be limited thereto, and for example, the range of applied voltage value or potential change may be from about −3.2 V to about −1.4 V, from about −3.0 V to about −1.4 V, from about −2.8 V to about −1.4 V, from about −2.6 V to about −1.4 V, from about −2.4 V to about −1.4 V, from about −2.2 V to about −1.4 V, from about −2.0 V to about −1.4 V, from about −1.8 V to about −1.4 V, from about −1.6 V to about −1.4 V, from about −3.2 V to about −1.6 V, from about −3.2 V to about −1.8 V, from about −3.2 V to about −2.0 V, from about −3.2 V to about −2.2 V, from about −3.2 V to about −2.4 V, from about −3.2 V to about −2.6 V, from about −3.2 V to about −2.8 V, or from about −3.2 V to about −3.0 V, but may not be limited thereto.

In an embodiment of the present disclosure, the oxalate salt may be represented by the following Chemical Formula 1, but may not be limited thereto:

$$M_xC_2O_4; \quad \text{[Chemical Formula 1]}$$

In the above Formula, M is Zn, Mg, Li, Na, or Al, and x is 1 or 2.

In an embodiment of the present disclosure, a purity of the oxalate salt may be about 90% or more. For example, the purity of the oxalate salt may be about 90% or more, about 91% or more, about 92% or more, about 93% or more, about 94% or more, about 95% or more, about 96% or more, about 97% or more, about 98% or more, about 99% or more, from about 90% to about 99%, from about 92% to about 98%, or from about 94% to about 96%. For example, when the system for electrochemical conversion of carbon dioxide contains dimethyl sulfoxide as the aprotic polar organic solvent and tetrabutylammonium hexafluorophosphate as the auxiliary electrolyte, the oxalate salt produced by electrochemically reducing carbon dioxide supplied to the reduction electrode unit may have a purity of about 90% or more.

Figure 1B:
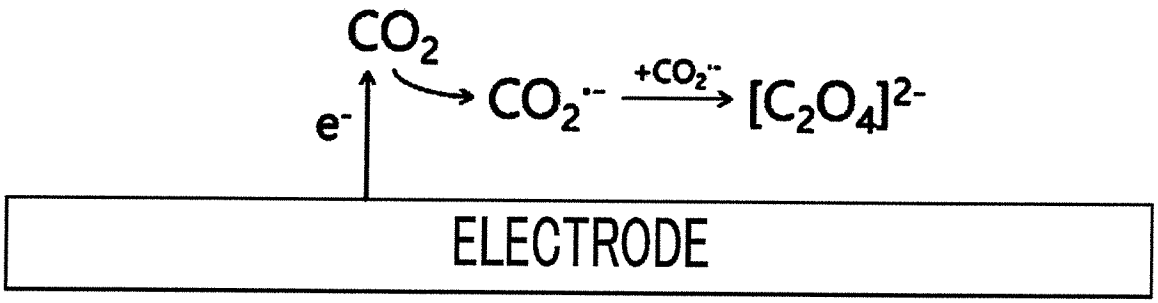
FIG. 1B illustrates a reduction reaction of carbon dioxide in an aprotic organic solvent as an electrochemical reduction mechanism of carbon dioxide according to an embodiment of the present disclosure

The system for electrochemical conversion of carbon dioxide may have a different carbon dioxide reduction path for each electrolyte, and, thus, it is possible to select a converted product. For example, in an aqueous solution, a carbon dioxide molecule receives an electron from an electrode and become a radical to be combined with a hydrogen ion of an electrolyte and then adsorbed onto the electrode. Radicalization of a stable carbon dioxide molecule with sp-hybrid orbital requires a lot of thermodynamic energy and thus may be considered as a process for determining a reaction rate. Then, when the adsorbed HCOO radical anion receives an electron and is desorbed from the electrode, a formate ($HCOO^-$) is produced, and when it is combined with a hydrogen ion of the electrolyte through dehydration and then desorbed, carbon monoxide (CO) is produced (FIG. 1A). As for an aprotic organic solvent, no hydrogen ion is present in an electrolyte. Therefore, a carbon dioxide molecule becomes a radical and then is combined with another carbon dioxide radical to produce an oxalate salt ($C_2O_4^{2-}$) (FIG. 1B). A reduction reaction of carbon dioxide has a different path for each metal, and it is known to be determined by an overvoltage for hydrogen production reaction of a metal electrode or a combination method based on the orbital form.

The system for electrochemical conversion of carbon dioxide according to an embodiment of the present disclosure has the advantages of conventional systems for electrochemical conversion of carbon dioxide and also produces a high-purity oxalate salt to be available for industrialization and is environmentally friendly.

Hereafter, the present disclosure will be explained in more detail with reference to Examples, but is not limited thereto.

MODE FOR CARRYING OUT THE INVENTION

Example 1

Figure 3:
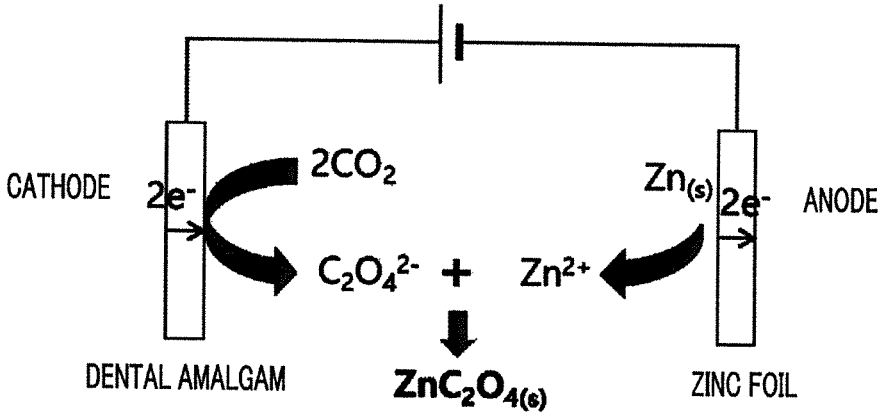
FIG. 3 shows a system for electrochemical conversion of carbon dioxide using a dental amalgam electrode according to an example of the present disclosure.

System 1 for Reduction of Carbon Dioxide Using Aprotic Polar Organic Solvent In the present Example, a system configured using a dental amalgam electrode as a working electrode, a sacrificial zinc anode as a counter electrode, $Ag/Ag^+$ (each solution added with 1 mM $AgClO_4$ in electrolyte conditions) as a reference electrode, dimethyl sulfoxide (DMSO) as a solvent, and tetrabutylammonium hexafluorophosphate ($TBA.PF_6$) as an auxiliary electrolyte was adopted. The carbon dioxide-oxalate salt conversion system according to the present Example was as shown in FIG. 3.

Similar to a conventionally known electrolyte, 0.1 M TBAP electrolyte dissolved in acetonitrile, the electrolyte, 0.1 M $TBA.PF_6$ dissolved in DMSO, used in the present Example stably produced an oxalate salt at room temperature. Since DMSO was almost not evaporated as compared with acetonitrile, the volatility and risk of explosion which is a problem of conventional electrolytes could be removed. Therefore, the system could have a simple configuration and the device configuration cost could be reduced.

As for an electrode, the dental amalgam electrode is a material approved by U.S. FDA and regarded as harmless to humans and thus could improve environment friendliness as compared with a lead electrode. The risk of large-scale electrodes required for industrialization could be effectively reduced.

COMPARATIVE EXAMPLE 1

Figure 2:
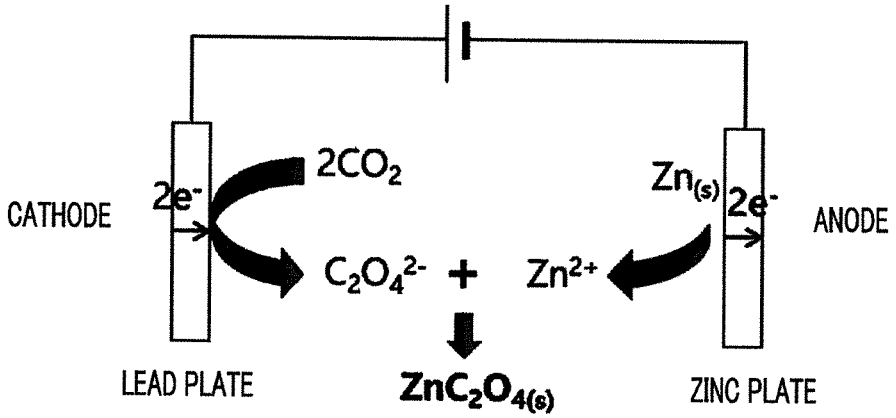
FIG. 2 shows a system for electrochemical conversion of carbon dioxide using a lead electrode according to an embodiment of the present disclosure.

A conventionally known system was used as a comparative example, and the present system used a lead (Pb) plate electrode (1 $cm^2$), a sacrificial zinc anode (1 $cm^2$), an Ag rod (Quasi reference electrode), acetonitrile, and tetrabutylammonium perchlorate (TBAP) as a working electrode, a counter electrode, a reference electrode, a solvent, and an auxiliary electrolyte, respectively. The carbon dioxide-oxalate salt conversion system according to the present Comparative Example was as shown in FIG. 2. In the system, the oxalate salt showed a current density of about 40 $mA/cm^2$ at 5° C. and −2.6 V vs Ag with faradaic efficiency (F/E) of 96%.

TEST EXAMPLE 1

Carbon Dioxide Conversion Test 1

In order to check the efficiency of producing an oxalate salt by the systems according to Example 1 and Comparative Example 1, respectively, the faradaic efficiency of the oxalate salt in the product was measured for comparison by permanganate titration.

Similar to the electrolyte, 0.1 M TBAP electrolyte dissolved in acetonitrile, as used in Comparative Example 1, the electrolyte, 0.1 M $TBA.PF_6$dissolved in DMSO, used in Example 1 stably produced an oxalate salt at room temperature. Since DMSO was almost not evaporated as compared with acetonitrile, the volatility and risk of explosion of conventional electrolytes could be removed. Therefore, the system could have a simple configuration and the device configuration cost could be reduced. The following Table 1 shows data comparing the efficiency of producing an oxalate salt when a current of 200 C was applied in the conditions of the systems of Comparative Example 1 and Example 1, respectively.

TABLE 1

| | Electrode | Auxiliary electrolyte | Solvent | Temperature (° C.) | Applied voltage (V vs $Ag/Ag^+$) | Faradaic efficiency (%) |
|---|---|---|---|---|---|---|
| Comparative Example 1 | Lead | TBAP | Acetonitrile | 5 | −2.6 | 96 |
| | | | | 25 | −2.6 | 89 |
| Example 1 | Dental amalgam | TBA•$PF_6$ | DMSO | 25 | −3.0 | 92 |

COMPARATIVE EXAMPLE 2

As Comparative Example 2, a system for conversion of carbon dioxide was prepared using the same dental amalgam electrode in the same conditions as in Example 1 except that TBAP was used as an auxiliary electrolyte and DMF was used as a solvent.

TEST EXAMPLE 2

Carbon Dioxide Conversion Test 2

As for the purity of an oxalate salt product, an oxalate salt produced by the system for conversion of carbon dioxide according to Comparative Example 2 using the electrolyte, TBAP dissolved in DMF, in the dental amalgam electrode showed a very high faradaic efficiency but a low purity due to a lot of by-products. However, when the electrolyte, $TBA.PF_6$ dissolved in DMSO, adopted in Example 1 was used, a high-purity oxalate salt could be produced.

The following Table 2 shows data comparing the purity and efficiency of producing an oxalate salt when a current of 200 C was applied in the conditions of the systems of Example 1 and Comparative Example 2, respectively.

TABLE 2

| | Auxiliary electrolyte | Solvent | Applied voltage (V vs $Ag/Ag^+$) | Yield-to-weight ratio (%) | Oxalate salt in product: Purity (%) | Oxalate salt in product: Faradaic efficiency (%) |
|---|---|---|---|---|---|---|
| Comparative Example 2 | TBAP | DMF | −3.0 | 114 | 84 | 96 |
| Example 1 | TBA•$PF_6$ | DMSO | −3.0 | 93 | 99 | 92 |

TEST EXAMPLE 3

Carbon Dioxide Conversion Test 3

Figure 4:
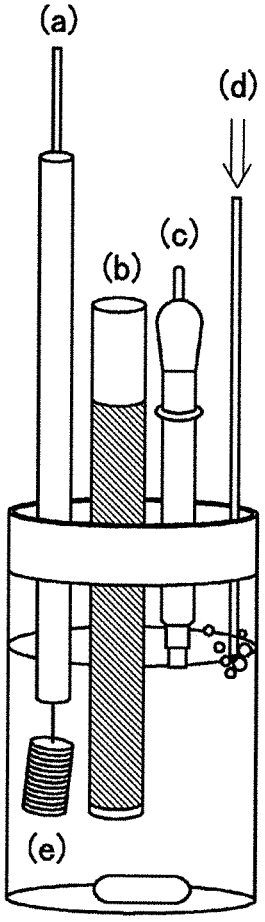
FIG. 4 shows a configuration of a cyclic amperometry tester using a dental amalgam electrode according to an example of the present disclosure.

Before the processing equipment was installed, a basic test for electrochemical conversion of carbon dioxide using a dental amalgam electrode in an aprotic organic solvent in the conditions as shown in FIG. 4 was carried out in order to check the potential of the invention. In the present test, cyclic voltammetry and chronoamperometry were used and a produced oxalate salt was titrated and quantified by permanganate titration.

In order to find solvent conditions for stable configuration of the system, dimethyl formamide (DMF) and dimethyl sulfoxide (DMSO) were tested instead of acetonitrile having high volatility. As an auxiliary electrolyte, tetrabutylammonium tetrafluoroborate (TBA.$BF_4$), tetrabutylammonium hexafluorophosphate (TBA.$PF_6$) and tetrabutylammonium perchlorate (TBAP) were tested. The six conditions were made by mixing the solvent candidates and the auxiliary electrolyte candidates and the electrochemical activity in each condition was checked by cyclic amperometry. Further, an argon (Ar) atmosphere was formed in the solution to check whether or not the electrolyte and the auxiliary electrolyte were reduced, and a carbon dioxide ($CO_2$) atmosphere was formed to check the activity of $CO_2$ and the results thereof were as shown in FIG. 5A through FIG. 5F.

Figure 5A:
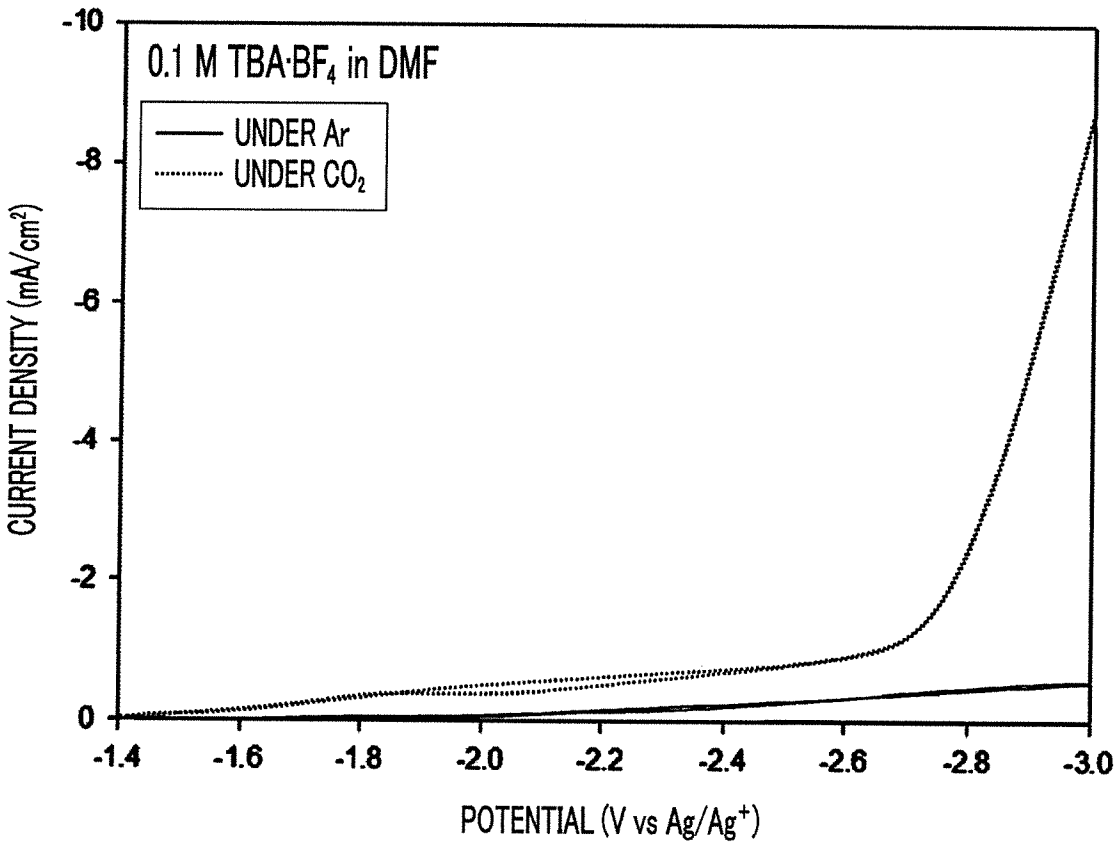
FIG. 5A through FIG. 5F are graphs showing cyclic currents and voltages under argon (Ar) and carbon dioxide ($CO_2$) depending on the kind of electrolyte according to an example of the present disclosure, and a potential scan rate is 50 mV/s.
Figure 5B:
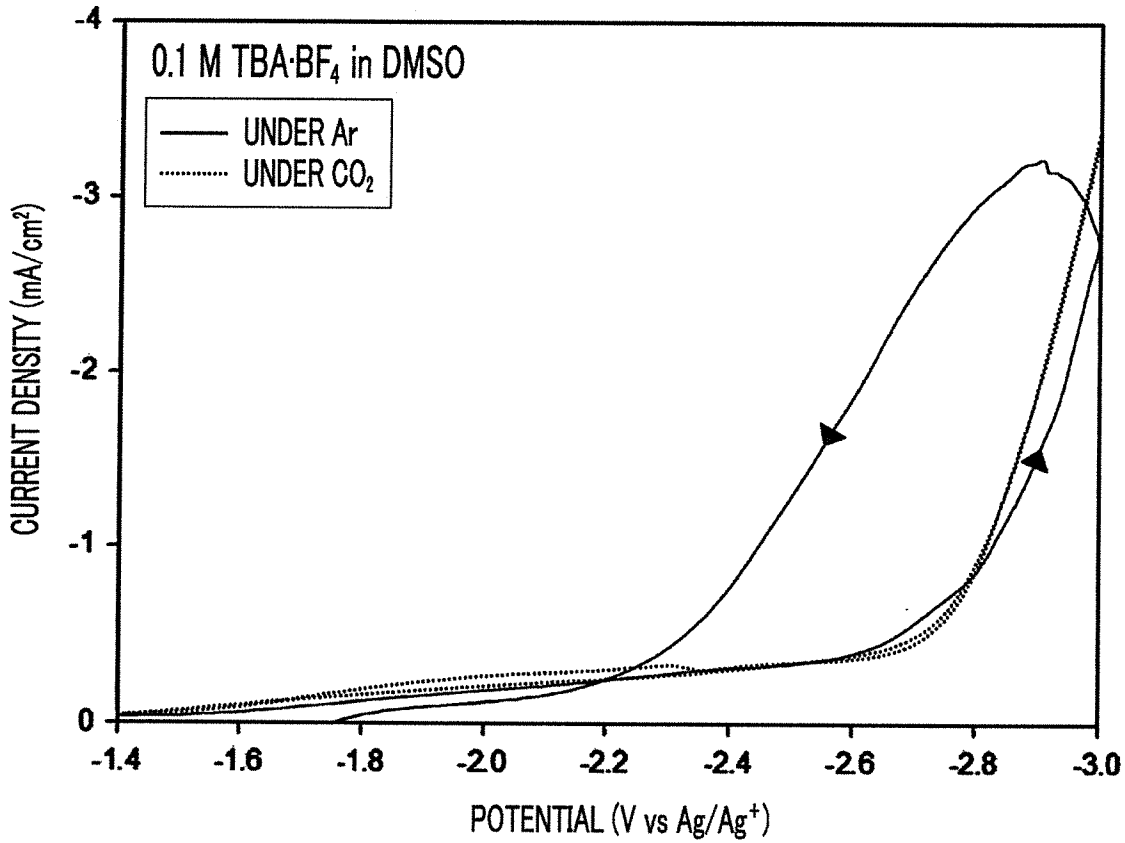
Figure 5C:
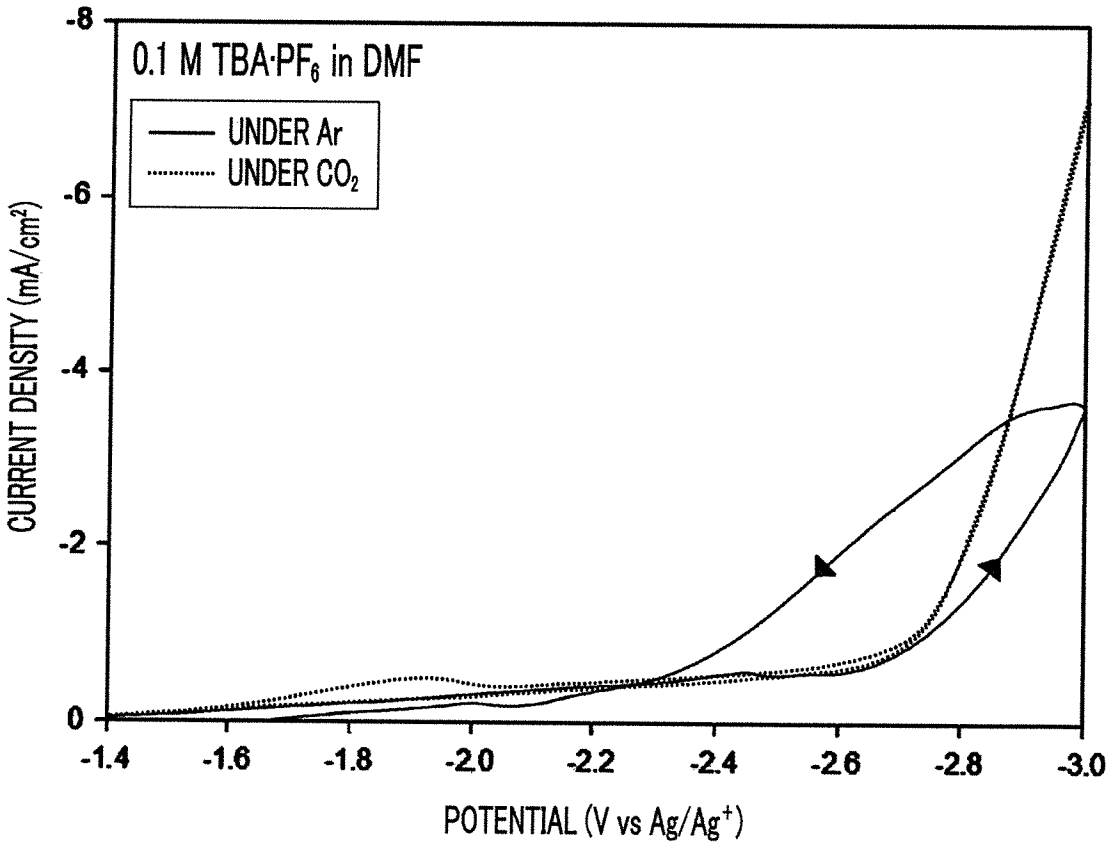
Figure 5D:
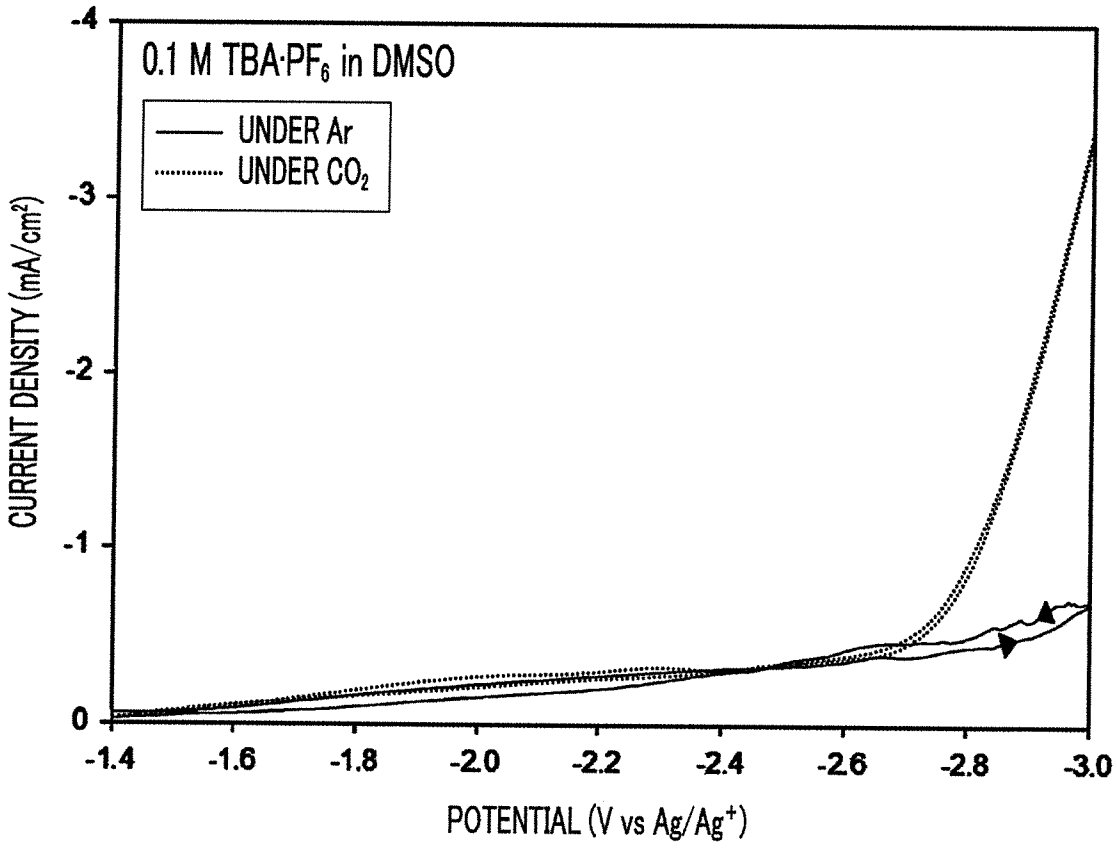
Figure 5E:
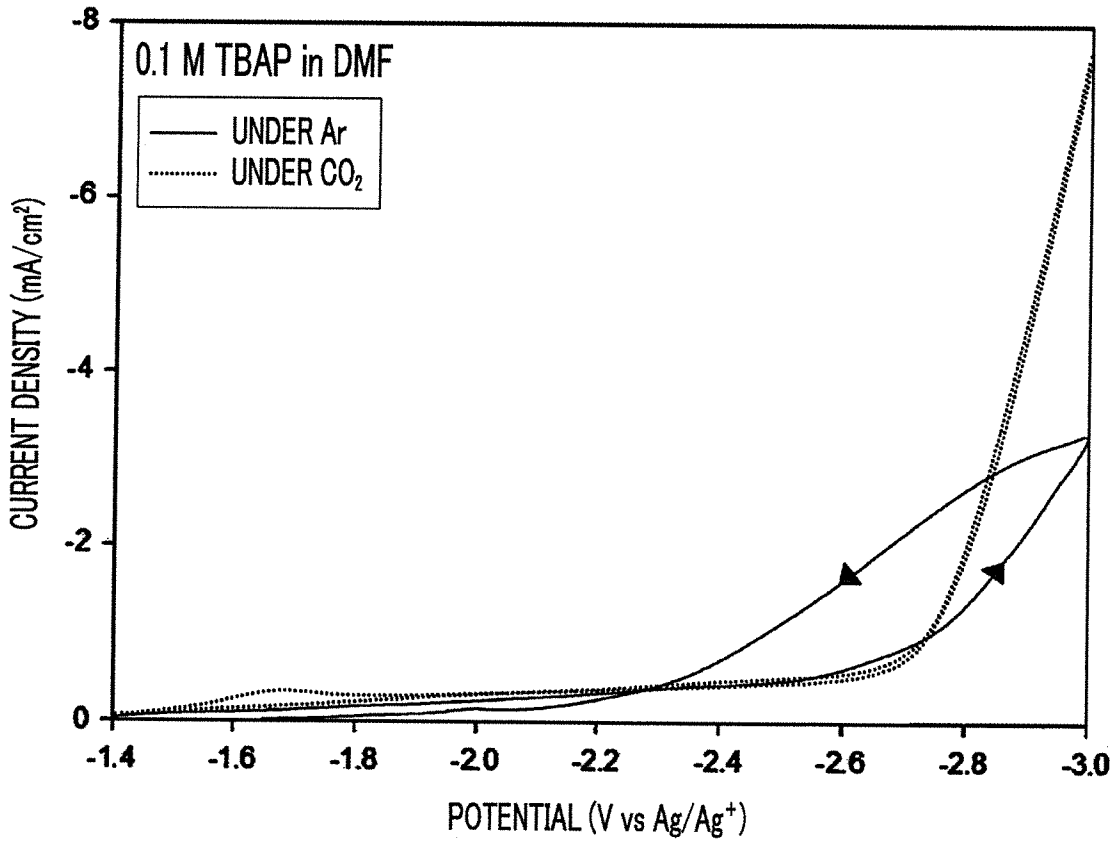
Figure 5F:
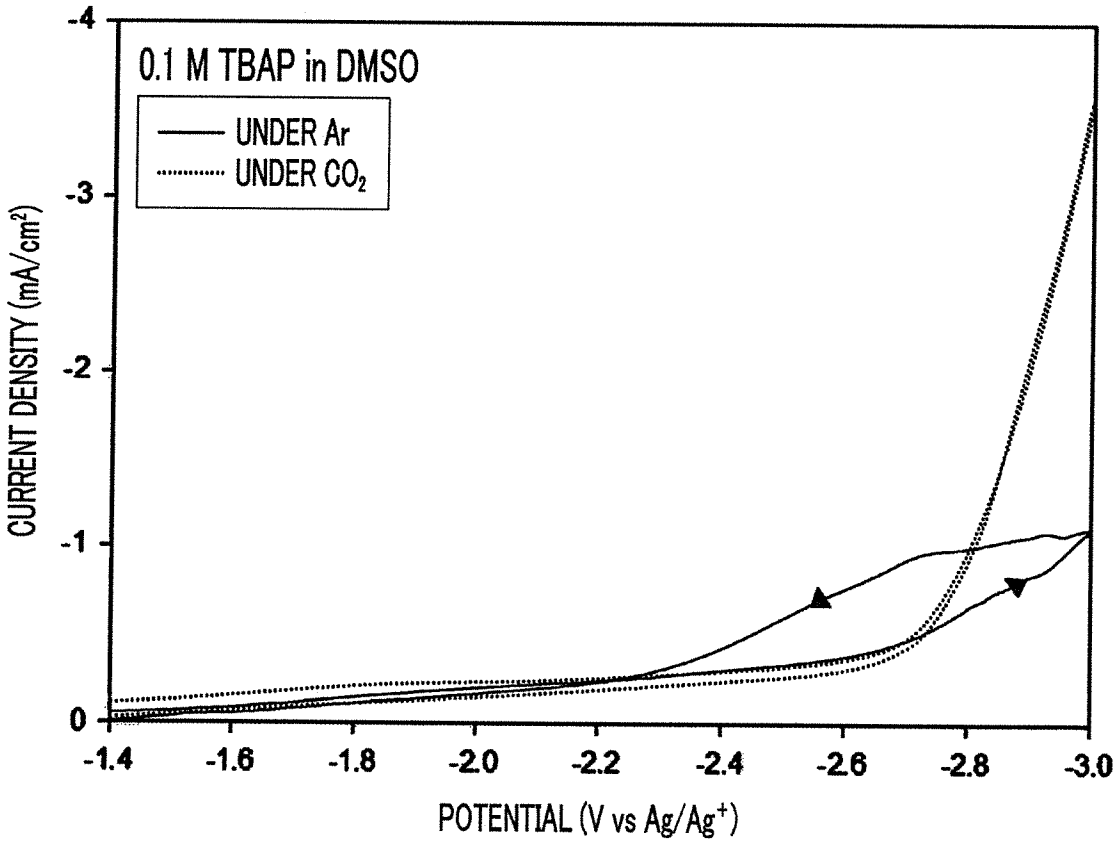

FIG. 5A through FIG. 5F show cyclic voltammetry data under Ar and $CO_2$ with different electrolyte conditions, respectively, and a potential scan rate was 50 mV/s. Specifically, FIG. 5A shows the case where 0.1 M TBA.$BF_4$ was used as an auxiliary electrolyte and DMF was used as a solvent, FIG. 5B shows the case where 0.1 M TBA.$BF_4$ was used as an auxiliary electrolyte and DMSO was used as a solvent, FIG. 5C shows the case where 0.1 M TBA.$PF_6$ was used as an auxiliary electrolyte and DMF was used as a solvent, FIG. 5D shows the case where 0.1 M TBAP was used as an auxiliary electrolyte and DMSO was used as a solvent, FIG. 5E shows the case where 0.1 M TBAP was used as an auxiliary electrolyte and DMF was used as a solvent, and FIG. 5F shows the case where 0.1 M TBA.$PF_6$ was used as an auxiliary electrolyte and DMSO was used as a solvent.

As shown in FIG. 5A through FIG. 5F, in the 0.1 M TBA.$BF_4$ dissolved in DMF and in the 0.1 M TBA.$PF_6$ dissolved in DMSO, a reduction reaction under $CO_2$ was much greater than a reduction reaction under Ar atmosphere, and, thus, it was determined that the reaction selectivity for $CO_2$ is high. In different conditions, a reaction was great under Ar atmosphere, and this reaction was considered as a reduction reaction of the electrolyte or auxiliary electrolyte. Referring to the current change under Ar atmosphere, a current in a first negative (−) direction is smaller than a current in a returning positive (+) direction, which means that an intermediate produced in a reduction reaction is reduced again. A reduction reaction of $CO_2$ in an aprotic organic solvent rarely produces an intermediate and is not great, and, thus, this reaction is considered as a reduction reaction of the electrolyte. In this case, by-products may be produced by side reactions and may reduce the purity of a product and the efficiency. Therefore, condition of 0.1 M TBA.$BF_4$ dissolved in DMF and 0.1 M TBA.$PF_6$ dissolved in DMSO with high reaction selectivity for $CO_2$ were selected.

EXAMPLE 2

Figure 6:
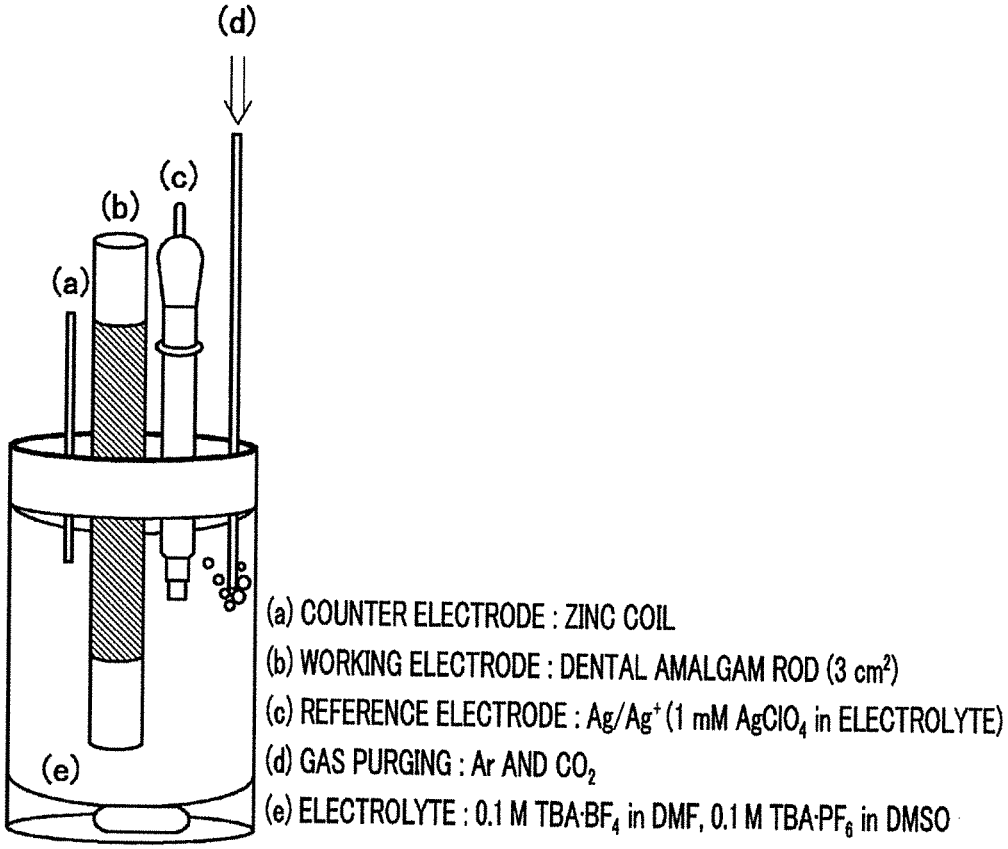
FIG. 6 shows a configuration of a system for electrochemical conversion of carbon dioxide using a dental amalgam electrode according to an example of the present disclosure.

In order to construct a tester for making a reduction reaction of $CO_2$ in the solvent and auxiliary electrolyte conditions determined by the above-described test, a dental amalgam electrode was used as a working electrode, a sacrificial zinc anode was used as a counter electrode, and a distance between the electrodes was minimized by surrounding the counter electrode with the working electrode and an electrolyte solution was circulated uniformly using a magnetic stirrer for smooth circulation of a reactant, as shown in FIG. 6. Further, 0.1 M TBA.$PF_6$ dissolved in DMSO was used as an electrolyte and gases (Ar and $CO_2$) were injected into the tester during electrolysis.

COMPARATIVE EXAMPLE 3

A tester was constructed in the same conditions as in Example 2 except that 0.1 M TBA.$BF_4$ dissolved in 10 mL of DMF was used as an electrolyte.

TEST EXAMPLE 4

Carbon Dioxide Conversion Test 4

Figure 7:
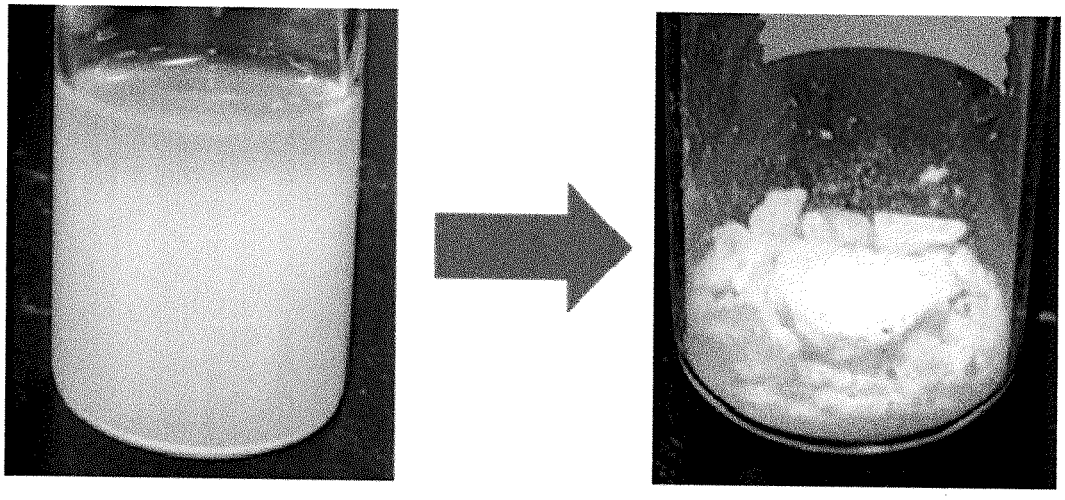
FIG. 7 shows real photos of a product when produced in a solution right after electrolysis and when reduced-pressure filtered and then dried according to an example of the present disclosure.
Figure 8:
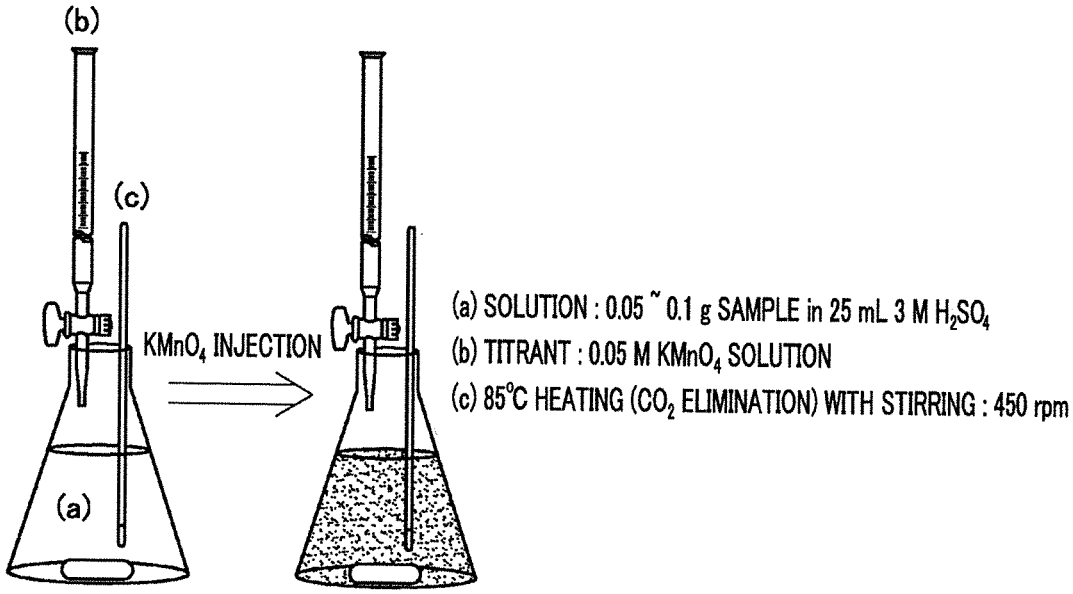
FIG. 8 shows a permanganate titration tester for measuring an oxalate salt produced by a system for conversion of carbon dioxide according to an example of the present disclosure.

As confirmed in Test Example 3 by cyclic voltammetry, a reduction reaction of an electrolyte was most different from a reduction reaction of $CO_2$ at a voltage ranging from −3.0 V to −3.2 V vs $Ag/Ag^+$, and, thus, −3.0 V vs $Ag/Ag^+$ was applied. As shown in FIG. 7, a $CO_2$-converted product was obtained by reduced-pressure filtering and drying a product produced in a solution after electrolysis.

The purity and faradaic efficiency of a product were calculated according to the following Equations by standardizing a potassium permanganate solution with a powder reagent $ZnC_2O_4$ (Sigma Aldrich) on the market and then titrating a powder product produced from the test. Specifically, the following Reaction Formula 1 shows a reaction between an oxalate salt and a permanganate ion in a product, the following Equation 1 is used to calculate the amount (purity) of an oxalate salt in a product, and the following Equation 2 is used to calculate the faradaic efficiency of producing an oxalate salt:

$$5ZnC_2O_4+8H_2SO_4+2KMnO_4 \rightarrow 5ZnSO_4+2MnSO_4+K_2SO_4+10CO_2+8H_2O; \quad \text{[Reaction Formula 1]}$$

$$n_{oxalate}=c\times V\times 5/2; \quad \text{[Equation 1]}$$

($n_{oxalate}$: Molar amount of oxalate salt, c: Concentration of $KMnO_4$ solution, V: Volume of titrated $KMnO_4$ solution)

$$n_{oxalate}=n_{oxalate}\times n\times F/Q; \quad \text{[Equation 2]}$$

(n: Number of electrons required for reaction, F: Faraday constant, Q: Total quantity of electric charge).

The suitability of each electrolyte condition was determined by comparing products produced in the respective electrolyte conditions in terms of their purity and faradaic efficiency. In order to configure an efficient system, the condition for the highest purity and the highest faradaic efficiency was determined as the optimum condition.

As shown in the following Table 3, when the products produced after 200 C electrolysis in the above-described two conditions (Example 2 and Comparative Example 3) were compared, the product produced in the condition of 0.1 M $TBA.BF_4$ dissolved in DMF showed a lower purity and a lower efficiency than the product produced in the condition of 0.1 M $TBA.PF_6$ dissolved in DMSO. Therefore, the condition of 0.1 M $TBA.PF_6$ dissolved in DMSO was determined and selected as the optimum condition.

TABLE 3

| | Auxiliary electrolyte | Solvent | Applied voltage (V vs $Ag/Ag^+$) | Yield-to-weight ratio (%) | Oxalate salt in product: Purity (%) | Oxalate salt in product: Faradaic efficiency (%) |
|---|---|---|---|---|---|---|
| Comparative Example 3 | $TBA\bullet BF_4$ | DMF | −3.0 | 148 | 53 | 81 |
| Example 2 | $TBA\bullet PF_6$ | DMSO | −3.0 | 93 | 99 | 92 |

Figure 9:
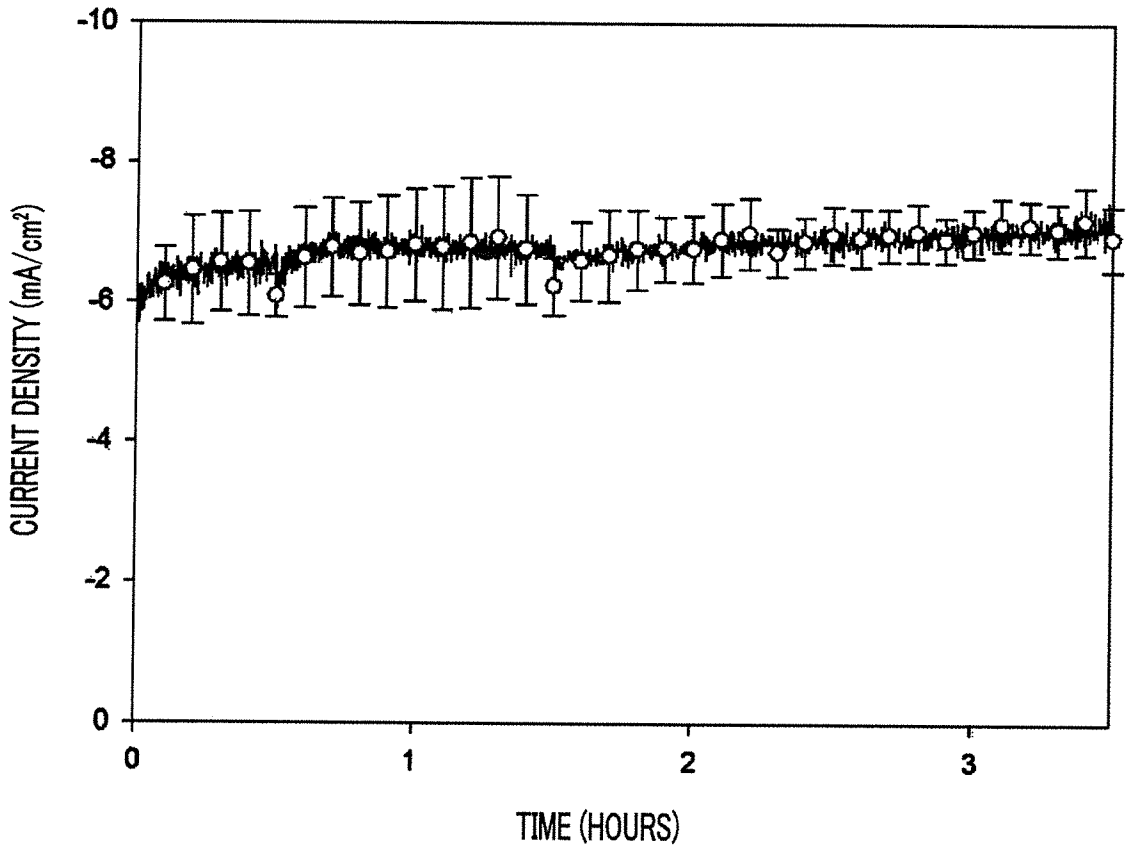
FIG. 9 is a graph showing an error range obtained as a standard deviation value by measuring a current (dot) three times when −3.0 V vs $Ag/Ag^+$ is applied to a dental amalgam electrode using a 0.1 M $TBA.PF_6$ solution dissolved in DMSO to electrochemically convert carbon dioxide into an oxalate salt according to an example of the present disclosure.

A current output when $CO_2$ was converted into an oxalate salt by electrochemically applying −3.0 V vs $Ag/Ag^+$ in the selected condition of 0.1 M $TBA.PF_6$ dissolved in DMSO was measured three times, and the measurement results were as shown in FIG. 9 and Table 4. Specifically, FIG. 9 shows an error range obtained as a standard deviation value by conducting a $CO_2$ conversion test three times and measuring a current density for each time, and specifically, FIG. 9 statistically shows current density values for three times of electrolysis, and the result of the above-described test 3 was as shown in Table 4.

Further, it was confirmed that when electrolysis was performed at a constant voltage of −3.0 V vs $Ag/Ag^+$ in the condition of 0.1 M $TBA.PF_6$ dissolved in DMSO as selected in Test Example 4, an oxalate salt could be produced at an efficiency of 90% or more, as shown in Table 4. Further, the purity of the product was high in the above-described condition, and, thus, the loss in a future acidification process could be reduced. Due to few side reactions, there was no difference in the surface of the electrode before and after electrolysis and there was no change in the electrolyte even after 20 or more hours of electrolysis. Therefore, the electrode could be reused.

TABLE 4

| Number of times | Quantity of electric charge (C) | Time (h) | Applied voltage (V vs $Ag/Ag^+$) | Current density ($mA/cm^2$) | Yield-to-weight ratio (%) | Oxalate salt in product: Purity (%) | Oxalate salt in product: Faradaic efficiency (%) |
|---|---|---|---|---|---|---|---|
| 1 | 200 | 3.5 | −3.0 | 7 | 100 | 90 | 94 |
| 2 | 204 | 3.5 | −3.0 | 6 | 93 | 99 | 92 |
| 3 | 200 | 3.3 | −3.2 | 6.5 | 97 | 94 | 91 |

Figure 10:
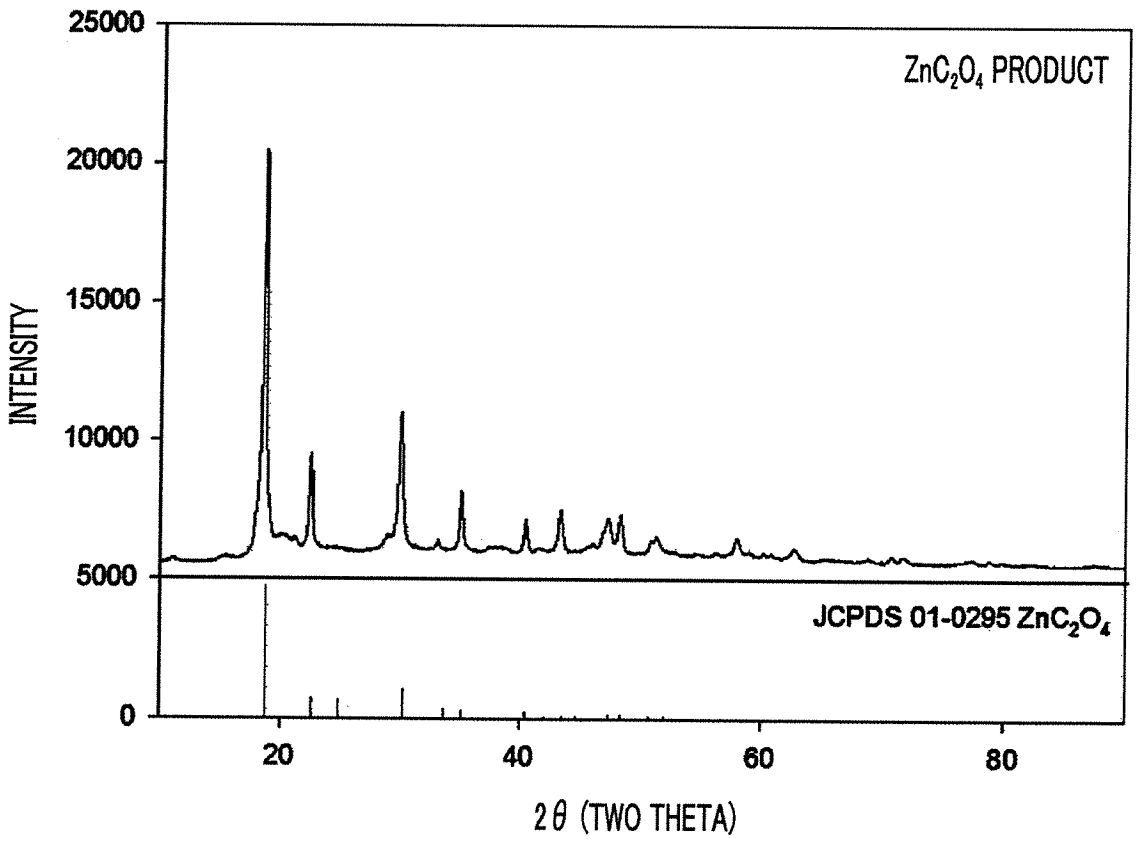
FIG. 10 shows XRD data of an electrolysis product according to an example of the present disclosure.
Figure 11:
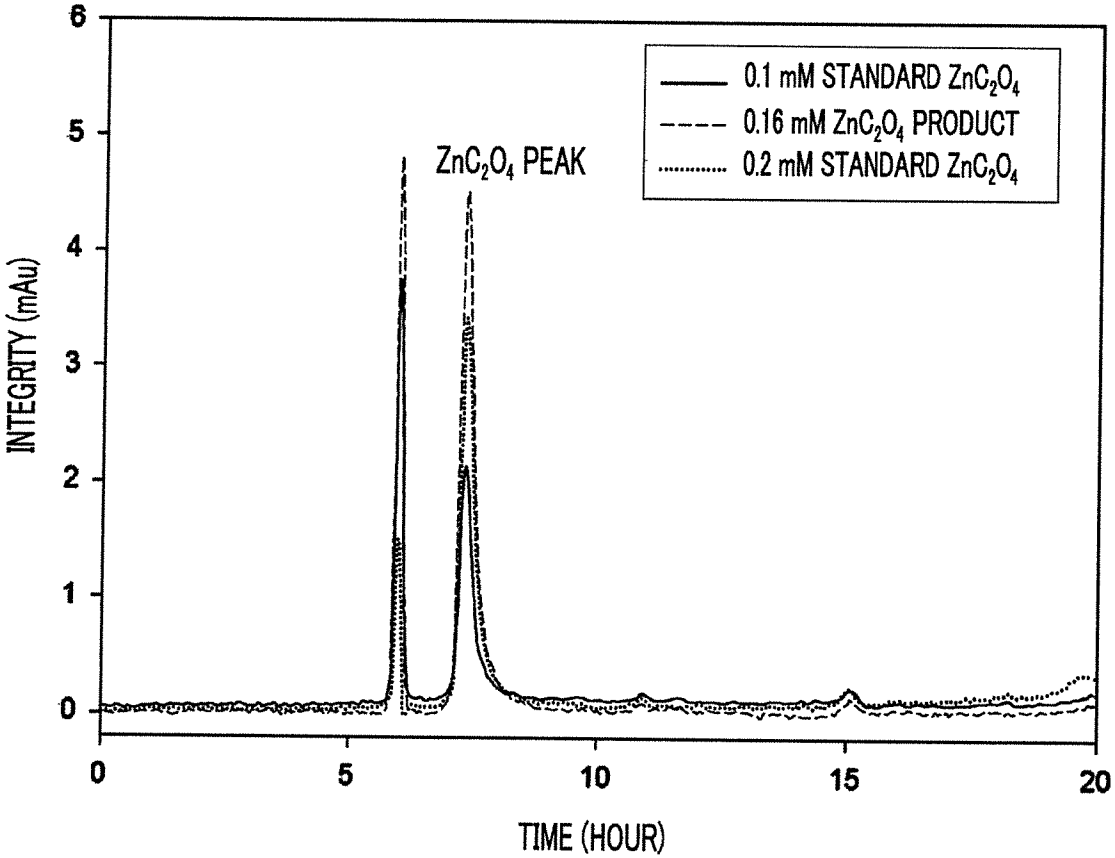
FIG. 11 shows HPLC data of a standard zinc oxalate and an electrolysis product according to an example of the present disclosure.

The product was checked by XRD analysis, and the result thereof confirmed that zinc oxalate ($ZnC_2O_4$) was produced, as shown in FIG. 10. Further, it was confirmed by high-performance liquid chromatography (HPLC) analysis that $ZnC_2O_4$ could be converted into an oxalate salt through acidification (FIG. 11). A 50 mM $HClO_4$ solution was used as an eluent for HPLC analysis, and acidification of the oxalate salt to an oxalic acid was confirmed. Specifically, after calibration with standard $ZnC_2O_4$, the concentration of sample $ZnC_2O_4$ obtained by electrolysis from the present Example was calculated. Accordingly, the concentration of the sample was calculated as 0.16 mM, and peaks appeared at the same retention time as shown in FIG. 11, which confirmed that the oxalate salt was acidified to an oxalic acid. The sample $ZnC_2O_4$ showed the same peaks as the standard $ZnC_2O_4$, and in this case, calibration was separately performed for each measurement. Thus, there may be a difference in intensity.

The above description of the present disclosure is provided for the purpose of illustration, and it would be understood by a person with ordinary skill in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

We claim:

1. A system for electrochemical conversion of carbon dioxide, comprising:

a reduction electrode unit to which carbon dioxide is supplied and including a metal-containing electrode;

an oxidation electrode unit including a sacrificial electrode; and an electrolyte unit including dimethyl sulfoxide as an aprotic polar organic solvent and tetrabutylammonium hexafluorophosphate (TBA $\cdot PF_6$) as an auxiliary electrolyte, wherein the aprotic polar organic solvent and the auxiliary electrolyte completely surround both the metal-containing electrode and the sacrificial electrode, wherein the carbon dioxide supplied to the reduction electrode unit is electrochemically reduced, at room temperature, so as to produce at the metal-containing electrode an oxalate salt having a purity of 90% or more when a constant voltage of −3.0 V to −3.2 V vs $Ag/Ag^+$is applied to the system, wherein the metal-containing electrode includes a member selected from the group consisting of Hg, Ag, Sn, Cu, Zn, Sb, alloys thereof, amalgam, and combinations thereof, and wherein the sacrificial electrode is Zn.

2. The system for electrochemical conversion of carbon dioxide of claim 1, wherein the oxalate salt is represented by the following Chemical Formula 1,

[Chemical Formula 1]

$M_xC_2O_4$;

wherein in the above Formula,

M is Zn, and x is 1 or 2.

3. The system for electrochemical conversion of carbon dioxide of claim 1, wherein the purity is between 90 to 99%.

4. The system for electrochemical conversion of carbon dioxide of claim 1, wherein the purity is between 91 to 99%.

5. The system for electrochemical conversion of carbon dioxide of claim 1, wherein the purity is between 92 to 98%.

6. The system for electrochemical conversion of carbon dioxide of claim 1, wherein the purity is between 94 to 96%.

* * * * *